US007400484B2

(12) United States Patent
Landinger

(10) Patent No.: US 7,400,484 B2
(45) Date of Patent: Jul. 15, 2008

(54) COAXIAL OVERVOLTAGE PROTECTOR

(75) Inventor: Josef Landinger, Aschau im Chiemgau (DE)

(73) Assignee: Spinner GmbH, Munich (DE)

( * ) Notice: Subject to any disclaimer, the term of this patent is extended or adjusted under 35 U.S.C. 154(b) by 186 days.

(21) Appl. No.: 11/354,235

(22) Filed: Feb. 15, 2006

(65) Prior Publication Data

US 2006/0181832 A1 Aug. 17, 2006

(30) Foreign Application Priority Data

Feb. 15, 2005 (DE) ..... 10 2005 006 829

(51) Int. Cl.
*H01C 7/12* (2006.01)

(52) U.S. Cl. ..... 361/117; 361/119

(58) Field of Classification Search ..... 361/117–120, 361/127

See application file for complete search history.

(56) References Cited

U.S. PATENT DOCUMENTS 6,101,080 A 8/2000 Kuhne
6,456,478 B1 9/2002 Kuhne
6,529,357 B1 3/2003 Landinger et al.
6,721,155 B2 * 4/2004 Ryman ..... 361/117

* cited by examiner

*Primary Examiner*—Michael J Sherry
*Assistant Examiner*—Danny Nguyen
(74) *Attorney, Agent, or Firm*—Edell, Shapiro & Finnan, LLC

(57) ABSTRACT

A coaxial overvoltage protector includes a coaxial line section from which a λ/4 short-circuit line branches off in a radial manner. The inner conductor of the short-circuit line is in electric contact with the inner conductor of the coaxial line section using a coaxial tubular capacitor. The tubular capacitor includes a conductive (metal) pin and the inner wall of the inner conductor of the coaxial line section. The conductive pin is arranged coaxially within the inner conductor of the coaxial line section and is electrically connected with the inner conductor of the short-circuit line, but is insulated from the inner conductor of the coaxial line section by a dielectric sleeve.

9 Claims, 2 Drawing Sheets

A-A

A-A

COAXIAL OVERVOLTAGE PROTECTOR

CROSS REFERENCE TO RELATED APPLICATIONS

This application claims priority under 35 U.S.C. § 119 to DE 10 2005 006 829.4, filed on Feb. 15, 2005 and titled "A Coaxial Surge Diverter", the entire contents of which are hereby incorporated by reference in its entirety.

FIELD OF THE INVENTION

The invention relates to a coaxial overvoltage protector including a coaxial line section and a λ/4 short-circuit line extending transversely from the section.

BACKGROUND

Surge diverters (also called overvoltage protectors) including a λ/4 short-circuit line are generally known. In the center frequency of the fundamental frequency band, the λ/4 line transforms the short-circuit line at its end into an idle state at its beginning. One advantage of this type of diverter is that they do not generate any intermodulation signals. A disadvantage of these diverters, however, is that no supply direct voltage can be transmitted via the coaxial line in the course of which the surge diverter is situated, which is a result of the electric connection between the inner conductor and the outer conductor of the surge diverter by the λ/4 short-circuit line.

U.S. Pat. Nos. 6,101,080 and 6,456,478 (both to Kuhne) disclose a coaxial surge diverter in which the end of the inner conductor of a short-circuit line is connected with its outer conductor via a concentrated capacitor dimensioned in such a way that the inner conductor and the outer conductor of the short-circuit line act in the fundamental frequency band as a transforming λ/4 short-circuit line. A gas discharge device is arranged parallel to the capacitor which ignites at a certain surge value. Because the outer conductor and the inner conductor of the coaxial line sections are electrically isolated from each other in normal operation, direct voltages or low-frequency alternating voltages can additionally be transmitted via a coaxial line containing this surge diverter. The gas discharge device is located in the HF field at the end of the short-circuit line, which leads to the consequence that the discharge path can be pre-ionized at least in the transmission of high HF outputs. This typically leads to of the production of intermodulation products, as well as to an undesirable reduction of the igniting voltage value. The contact between the inner conductor of the short-circuit line and its outer conductor (via the capacitor), moreover, describes the use of frequency ranges above approximately 1 GHz because a sufficient capacitance cannot be realized due to very limited space for lower frequencies by taking into account the surge impedance to be maintained.

Another type of surge diverter is disclosed in U.S. Pat. No. 6,529,357 (Landinger et al). In this diverter, the inner conductor of the λ/4 short-circuit line is arranged in a chamber formed in the outer conductor of the coaxial line section and is electrically in contact at its end with the outer conductor.

SUMMARY AND OBJECTS OF THE INVENTION

An object of the present invention is to provide a surge diverter (overvoltage protector) capable of transmitting a high HF output also on frequency bands below 1 GHz.

This object is achieved in accordance with the invention in such a way that the inner conductor of the short-circuit line is in electric contact with the inner conductor of the coaxial line section by way of a coaxial tubular capacitor.

A sufficiently large surface area is available for the formation of the tubular capacitor; alternatively, it can be provided by simple constructional measures on the inner conductor of the coaxial line section. The tubular capacitor can be easily dimensioned for the respectively required frequency-dependent capacitance value.

The tubular capacitor may comprise a conductive (metal) pin and the inner wall of the inner conductor of the coaxial line section, which metal pin is arranged coaxially in the inner conductor of the coaxial line section and is electrically connected with the inner conductor of the short-circuit line, but is insulated from the inner conductor of the coaxial line section by a dielectric sleeve.

A gas discharge device is preferably arranged between one of the ends of the metal pin and the inner conductor of the coaxial line section to position the gas discharge device in the field-free space. The gas discharge section is thus not pre-ionized by the HF-field.

The gas discharge device can be easily removed and replaced by configuring the inner conductor of the coaxial line section to be separable at positions near (e.g., above) the gas discharge device.

Preferably, the dielectric sleeve receives the gas discharge device such that is positioned at the end opposite the connection point between the metal pin and the inner conductor of the short-circuit line.

Access to the gas discharge device is simplified by further configuring the outer conductor of the coaxial line section to separate near (e.g., above) the separation point of the inner conductor of the coaxial line.

A compact configuration of the surge diverter is achieved when the short-circuit line is arranged substantially parallel to the longitudinal central axis of the surge diverter, with the exception of the section of its inner conductor which is in contact with the inner conductor of the coaxial line section.

The contact established between an end of the inner conductor of the λ/4 short-circuit line and the outer conductor of the coaxial line section may further comprise a strip transmission line. In the fundamental frequency range, the strip transmission line acts like a tubular capacitor whose capacitance can be brought to a value which is also sufficient for frequencies below 1 GHz by increasing the outside diameter and/or by extending the outer conductor. The strip transmission line may include a dielectric ring coaxially encompassing the outer conductor of the coaxial line section and a metal ring encompassing the metal ring, with which the end of the inner conductor of the short-circuit line is electrically connected.

In a further development of this embodiment, the metal ring is in contact with an electrode of a gas discharge device, whose other electrode is in contact with the outer conductor of the coaxial line section. As with the above embodiment, the gas discharge device is also positioned within the field-free space. The gas discharge device can be exchanged especially easily when the gas discharge device is inserted into a bore in the outer conductor of the coaxial line section proximate the metal ring and is spring-loaded, with the bore enclosed via a screw cap.

DETAILED DESCRIPTION

Figure 1A:
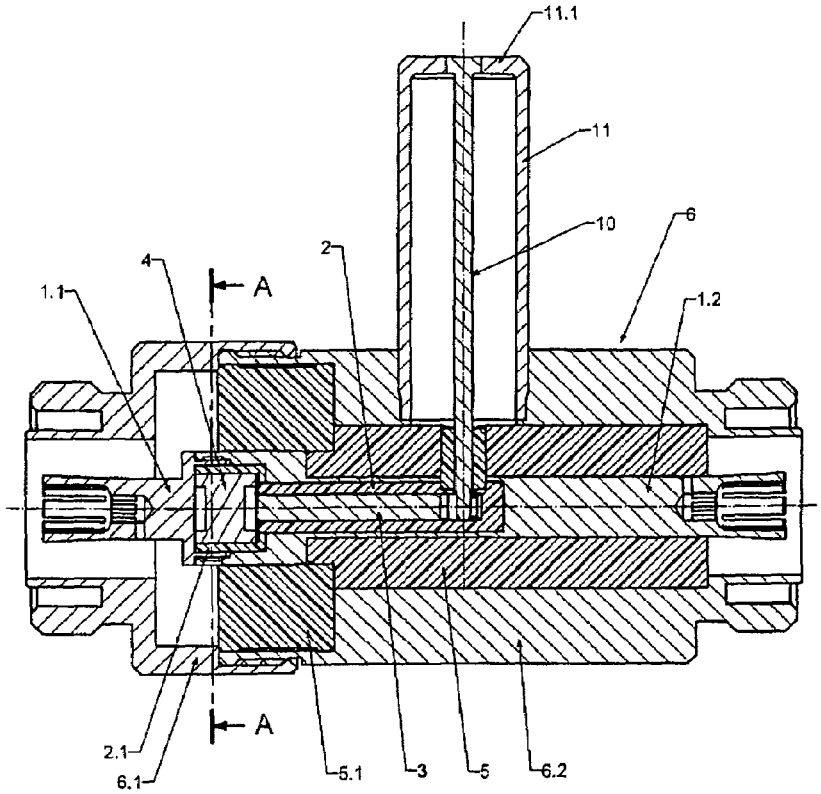
FIG. 1A illustrates a cross sectional view of an overvoltage protector according to an embodiment of the invention.
Figure 1B:
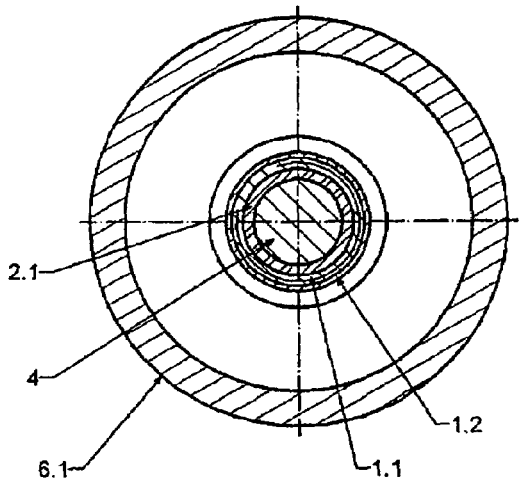
FIG. 1B illustrates a cross sectional view of the overvoltage protector of FIG. 1A, taken along line A-A.

FIGS. 1A and 1B are cross sectional views of the overvoltage protector (also called a surge diverter) according to an embodiment of the invention. Generally, the overvoltage protector comprises of a coaxial line section with plug-in connections on both sides, e.g. for insertion into the coaxial feed line of an antenna. The coaxial line section may comprise a first inner conductor section 1.1 coupled to a second inner conductor section 1.2 (e.g., first inner conductor 1.1 may threadingly engage the second inner conductor 1.2 so the conductor sections 1.1, 1.2 are separable). The second inner conductor section 1.2 includes a stepped axial bore into which an insulating sleeve 2 is positioned. The sleeve 2 is adapted to receive a conductive metal pin 3. One end of the metal pin 3 couples to (e.g., threadingly engages) an inner conductor 10 of a λ/4 short-circuit line. The inner conductor 10 extends radially from the coaxial line in an insulated manner, and is connected at its exposed end to a floor 11.1 of a tube 11. The tube 11 forms the outer conductor of the λ/4 short-circuit line.

The other end of the metal pin 3 extends into a recess formed in the second inner conductor section 1.2 (the outer diameter of the second inner conductor section 1.2 is enlarged in the area surrounding the insertion point). The recess, which may be cup-shaped, is lined with a sleeve 2.1 made of insulating material. The insulating sleeve 2.1 surrounds a gas discharge device 4 configured such that one electrode of the device 4 contacts the metal pin 3 and its other electrode contacts the first inner conductor section 1.1.

The internal space of the coaxial line may further include dielectric material 5 and 5.1 to reduce the mechanical length of the line. An outer conductor 6 is coaxially disposed with respect to the first and second inner conductor sections 1.1, 1.2, and includes an interior diameter corresponding to the diameter steps of the first and second inner conductor sections 1.1 and 1.2. Proximate the threaded connection between the first inner conductor section 1.1 and the second inner conductor section 1.2, the outer conductor 6 may also include a first outer conductor section 6.1 releasably coupled to a second outer conductor section 6.2 (e.g., via threaded engagement). As a result, the first outer conductor section 6.1 may be disconnected from the second outer conductor section 6.2. Similarly, the first inner conductor section 1.1 may be disconnected from the second inner conductor section 1.2. This enables the removal and replacement of the gas discharge device 4. Alternatively, when the outside conductor 6 comprises a sufficiently large diameter, access to the discharge device 4 may be provided via an integral configuration in which the inner conductor section can be removed from the plug-in side.

Figure 2A:
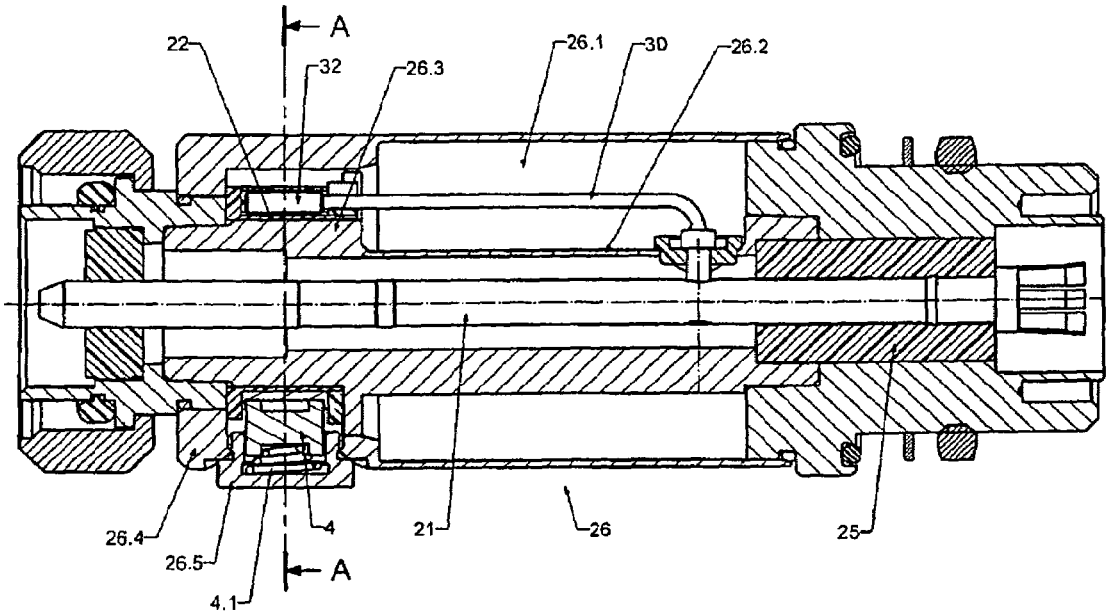
FIG. 2A illustrates a cross sectional view of an overvoltage protector according to another embodiment of the invention.
Figure 2B:
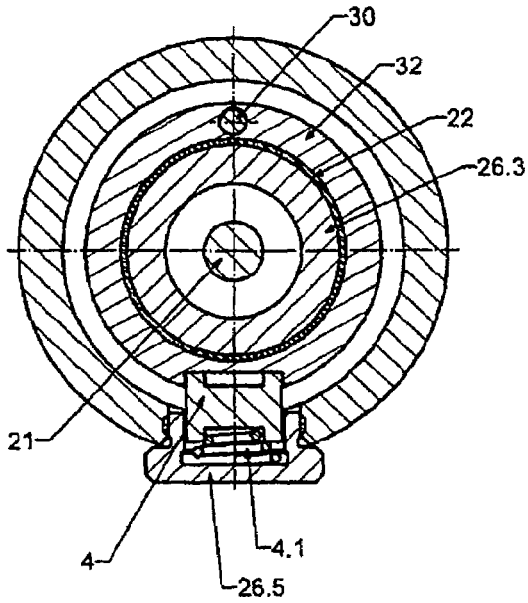
FIG. 2B illustrates a cross sectional view of the overvoltage protector of FIG. 2A, taken along line A-A.

FIGS. 2A and 2B show an overvoltage protector according to another embodiment of the invention. As illustrated, the overvoltage protector may comprise a coaxial line section with plug-in connections at both sides, e.g. for insertion into the coaxial feed line of an antenna. The coaxial line section comprises an inner conductor 21 partially enclosed by a dielectric 25 and coaxially positioned within an outer conductor 26. A chamber 26.1 is formed in the outer conductor 26. The walls of the chamber 26.1 form the outer conductor of a λ/4 short-circuit line. An inner conductor 30 passes through an insulated portion of the chamber (outer conductor) wall 26.2, bends approximately 90°, and connects in an electrically conductive manner with the inner conductor 21 of the coaxial line section.

The end of the inner conductor 30 of the λ/4 short-circuit line is connected in an electrically conductive manner with a conductive (e.g., metallic) ring 32 that encloses a section 26.3 of the outer conductor 26 of the coaxial line section, but is separated from the same by an interposed dielectric annular sleeve 22. The outer conductor section 26.3, the dielectric annular sleeve 22, and the conductive ring 32 jointly form a strip transmission line which functions as a tubular capacitor in the fundamental frequency range. The outer conductor 26 may further comprise a radial bore in its outer jacket 26.4 (which, in this embodiment, is diametrically opposed to the end of the inner conductor 30 of the λ/4 short-circuit line). A gas discharge device 4 may be positioned within the radial bore, with one electrode contacting the conductive ring 32 in an electrically conductive manner. The other electrode of the gas discharge device 4, furthermore, contacts a screw cap 26.5 by way of a conical coil spring 4.1. The screw cap 26.5 is adapted to seal off the radial bore in the outer jacket 26.4.

The invention claimed is:

1. An overvoltage protector comprising:

a coaxial line section including an outer conductor and an inner conductor;

a λ/4 short-circuit line including an inner conductor, wherein the short-circuit line extends radially from the coaxial line section; and a coaxial tubular capacitor configured to electrically connect the inner conductor of the coaxial line section with the inner conductor of the short-circuit line, the tubular capacitor comprising a conductive pin coaxially arranged within the inner conductor of the coaxial line section, wherein:

the conductive pin includes a first end and a second end, the first end of the conductive pin is electrically connected to the inner conductor of the short-circuit line, and a dielectric sleeve insulates the conductive pin from the inner conductor of the coaxial line section.

2. The overvoltage protector of claim 1 further comprising a gas discharge device disposed between the second end of the conductive pin and the inner conductor of the coaxial line section.

3. The overvoltage protector of claim 2, wherein the inner conductor of the coaxial line section is configured to separate at a point that provides access to the gas discharge device.

4. The overvoltage protector of claim 2, wherein the dielectric sleeve is configured to receive the gas discharge device.

5. The overvoltage protector of claim 3, wherein the outer conductor is configured to separate proximate the separation point of the inner conductor of the coaxial line section.

6. The overvoltage protector of claim 1, wherein a portion of the short-circuit line is disposed substantially parallel to the longitudinal central axis of the coaxial line section.

7. An overvoltage protector comprising:

a coaxial line section including an outer conductor and an inner conductor, the outer conductor comprising a chamber;

a λ/4 short-circuit line including an inner conductor extending radially from the inner conductor of the coaxial line section, through an insulated portion of the outer conductor wall, and into the outer conductor chamber such that the axis of the inner conductor of the short-circuit line is generally parallel to the axis of the inner conductor of the coaxial line section; and a strip transmission line electrically connecting the inner conductor of the short-circuit line to the outer conductor, the strip transmission line comprising a dielectric ring surounding a section of the outer conductor and a conductive ring surrounding the dielectric ring, wherein an end of the inner conductor of the short-circuit line is electrically connected to the conductive ring.

8. The overvoltage protector of claim 7 further comprising a gas discharge device including a first electrode and a second electrode, wherein the conductive ring is connected the first electrode and the outer conductor is connected to the second electrode.

9. The overvoltage protector of claim 8, wherein:

the outer conductor of the coaxial line section comprises a radial bore;

the gas discharge device is positioned within the bore such that the first end connects to the conductive ring and the second end connects to a threaded cap via a spring; and the threaded cap is configured to seal the bore.

* * * * *